United States Patent [19]

Peterson

[11] Patent Number: 4,566,538

[45] Date of Patent: Jan. 28, 1986

[54] FAIL-SAFE ONE TRIP PERFORATING AND GRAVEL PACK SYSTEM

[75] Inventor: Elmer R. Peterson, Houston, Tex.

[73] Assignee: Baker Oil Tools, Inc., Orange, Calif.

[21] Appl. No.: 593,426

[22] Filed: Mar. 26, 1984

[51] Int. Cl.[4] ..... E21B 43/08; E21B 43/116

[52] U.S. Cl. ..... 166/278; 166/55; 166/297; 175/4.56

[58] Field of Search ..... 175/4.52, 4.54, 4.56; 166/297, 278, 55, 55.1, 131, 133, 138, 118; 102/319-321; 89/1 C

[56] References Cited

U.S. PATENT DOCUMENTS

| | | | |
|---|---|---|---|
| 2,760,408 | 8/1956 | Taylor | 175/4.54 |
| 3,040,808 | 6/1962 | Schramm et al. | 175/4.52 |
| 3,800,705 | 4/1974 | Tamplen | 175/4.56 |
| 4,372,384 | 2/1983 | Kinney | 175/4.52 |
| 4,484,632 | 11/1984 | Vann | 175/4.52 |

OTHER PUBLICATIONS

Brochure Entitled "Flopetrol Johnson Tubing Conveyed Perforating Systems" by Schlumberger, Printed Jul. 1983.

*Primary Examiner*—Stephen J. Novosad
*Assistant Examiner*—Bruce M. Kisliuk
*Attorney, Agent, or Firm*—Norvell & Associates

[57] ABSTRACT

The disclosure provides a method and apparatus for effecting the fail-safe perforating of a well casing and gravel packing of the perforated areas of the well casing and the screen with one trip into the well of a combined perforating and gravel packing apparatus which includes packer means and a screen. The gravel packing apparatus provides, in its run-in position in the casing, a continuous annular passage along its entire length, thus permitting fluid pressure to be applied through the casing annulus to a crossover tool and then to the firing mechanism of a perforating gun. The firing mechanism for the perforating gun incorporates a hammer mechanism responsive to fluid pressure supplied from the casing annulus but which will not release until a predetermined level of fluid pressure is applied thereto. If, after the hammer is actuated, the perforating gun fails to fire, the application of a reverse fluid pressure differential to the hammer will effect the retraction of the hammer to its original latched position, ready for a second application of fluid pressure through the casing annulus to release the hammer and again impact the primer to discharge the perforating gun. Following perforating, the gravel packing of the screen and perforations is accomplished by shifting the gravel packing apparatus downwardly and then dropping a ball on a seat to permit fluid pressure to be developed to set a fluid pressure actuated packer.

17 Claims, 13 Drawing Figures

FAIL-SAFE ONE TRIP PERFORATING AND GRAVEL PACK SYSTEM

BACKGROUND OF THE INVENTION

1. FIELD OF THE INVENTION

The invention relates to a method and apparatus for effecting the perforating and the gravel packing of a production zone in a subterranean well by a single trip of a tubular tool string into the well which carries both perforating and gravel packing apparatus.

2. DESCRIPTION OF THE PRIOR ART

As oil and gas wells are drilled to constantly increasing depths, the cost of completion or the workover of a well is disproportionately increased by the number of trips of completion apparatus that must be made into the well in order to effect its completion or workover. Necessarily every encased producing well has to have the casing perforated in the production zone. It is equally necessary in the case of many wells having unconsolidated production formations to provide gravel packing in the area of the perforations to filter out sand produced with the production fluids and thus prevent entry of sand into the well bore and through the casing perforations into the production conduit. In co-pending application, Ser. No. 501,262, filed June 6, 1983, and assigned to the Assignee of this application (BSC-55-CONT), there is disclosed a combined gravel packing and perforating apparatus which may be run into the well and, in a single trip, effect the perforating of the well casing, and the gravel packing of the perforations and a screen attached to the bottom of the tubular tool string.

Necessarily a substantial amount of apparatus has to be assembled on the tool string to produce the one trip gravel packing and perforating apparatus. Hence, the run-in of such a substantial length of tools in a tubular string generally requires a slower operation than when a perforating gun or gravel packing apparatus is run in individually. Nevertheless, if the gravel packing and perforating of the well casing can be accomplished in a single trip of the lengthy tool string into the well, it is economically desirable. Unfortunately, all of the economic advantages would be lost if the perforating gun fails to fire, once it is in its proper position relative to the production formation.

This is particularly true when the perforating gun is fired by dropping a detonating bar through the tubular string and the assembled gravel packing and perforating apparatus. There are a large number of reasons why a detonating bar will arrive at the perforating with insufficient energy to discharge the impact actuated primer. For example, the well bore may have substantial deviations from the vertical which would substantially slow down the downward speed of the detonating bar. Particulate material or debris may collect in the perforating gun around the firing mechanism and absorb or cushion the impact of the detonating bar, thus resulting in insufficient impact energy to actuate the primer.

In the co-pending application, Ser. No. 593,364 filed concurrently herewith (BSC-102), and assigned to the Assignee of this application, there is disclosed and claimed a fluid pressure actuated firing mechanism wherein a firing hammer may be repeatedly actuated by reversing the fluid pressure differential acting on the hammer to return it to an elevated position with respect to the firing pin if the primer fails to discharge. It is therefore desirable to employ this type of firing mechanism in a single trip perforating and gravel packing apparatus; however, such single trip apparatus generally includes a fluid pressure actuated packer above the screen which, if fluid pressure were employed to actuate the firing mechanism for the perforating gun, the same fluid pressure would result in prematurely setting the packer, thus requiring considerable mechanical manipulation to unset the packer in order to shift the screen to a position adjacent the casing formations resulting from the firing of the perforating gun.

Accordingly, there is a need for a fail-safe type of single trip combined gravel packer and perforating gun which may be run into the well with the assurance that the gun can be eventually fired by a fluid pressure actuated mechanism permitting repeated attempts to discharge the detonatable primer to be made without disturbing the position of the perforating gun in the well casing or prematurely setting a packer.

SUMMARY OF THE INVENTION

As mentioned, in co-pending patent application Ser. No. 593,364 (BSC-102), there is disclosed a well perforating gun assembly which includes a conventional perforating gun secured to the bottom of a tubular actuating housing containing a fluid pressure actuated hammer and a fixedly mounted impact type primer against which the hammer is impacted. A latching collet normally maintains the hammer in an elevated position with respect to the primer but such latch may be released through the application of sufficient fluid pressure force to the upper portions of the hammer to drive it downwardly into engagement with the primer.

The single trip gravel packing and well perforating apparatus embodying this invention provides, in the run-in position of the apparatus, an upper fluid pressure settable packer, a releasable setting tool for the upper packer, a special crossover mandrel suspended from the setting tool initially having an open fluid passage, a liner assembly including a screen suspended from the upper packer, a lower mechanically actuated packer, a crossover tool suspended from the lower packer and a hammer housing and a perforating gun suspended from the crossover tool. Thus there is an uninterrupted fluid passage for the transmission of fluid pressure from the casing annulus to the fluid pressure actuated hammer of the perforating gun. The hammer is resiliently latched in an elevated position, hence requires the application of a predetermined fluid pressure to drive it onto the detonatable primer. If the primer fails to detonate after the initial impact by the hammer, a second fluid pressure may be supplied from the well head through the tubular tool string to elevate the hammer to its original latched position, ready for a second application of fluid pressure through the casing annulus to release the hammer again and impact the primer. Obviously, the upper packer is not set by the fluid pressure required to elevate the hammer. It is thus assured that the primer, if it is in a firable condition, will be detonated by one or more blows from the fluid pressure actuated hammer, and the perforating gun will thus be discharged to perforate the casing and the adjoining production formation.

The crossover tool serves a dual function in that it also provides for an immediate flow of production fluid from the perforated formation. The tubing string may be maintained in either a dry condition or filled with a light density fluid so that when firing occurs, the perforation zone is in what is commonly referred to as an underbalanced condition wherein the fluid pressure of the production fluid substantially exceeds the fluid pressure in the tubing string into which the production fluid will flow through the crossover tool.

The special crossover flow control mandrel in its run-in position defines the aforementioned unimpeded axial fluid passage through the entire gravel packing apparatus and screen, thus permitting a modest fluid pressure to be applied through the bore of the tubular work string to return the hammer of the perforating apparatus to its elevated position, if required. The special flow control mandrel also defines an axially extending, semi-annular passage separate from the axial passage. During the run-in and perforating operation, a radial passage through the flow control mandrel, which provides communication from the bore of the mandrel through the fluid passage into the annulus between the mandrel and the liner assembly, is closed by a sleeve which carries a ball valve seat in its upper end. The sleeve is retained in this position by shear pins.

Following the perforating operation, the lower packer is unset and the entire tool string lowered to position the screen adjacent the newly formed perforations and the lower packer is mechanically reset. A ball is dropped onto the ball seat permitting fluid pressure within the tubular tool string to be increased sufficiently to set the fluid pressure operated packer carried by the tool string. Further increase in pressure will cause a shearing of the shear pins and a downward movement of the ball seat sleeve to uncover the radial passage through the crossover mandrel to the customary configuration, which permits the flow of gravel carrying fluid downwardly through the bore of the mandrel, thence outwardly through the uncovered radial passage into the annulus between the exterior of the crossover tool and the liner assembly, thence outwardly into the annulus between the liner assembly and the casing, thence downwardly into the annular area between the liner assembly and the casing, thence downwardly into the annular area between the screen and casing, thence depositing the gravel, thence upwardly into the semi-annular passage of the crossover mandrel, and thence outwardly into the casing annulus through a radial port located above the packer, in conventional fashion.

DESCRIPTION OF THE PREFERRED EMBODIMENT

Figure 1A:
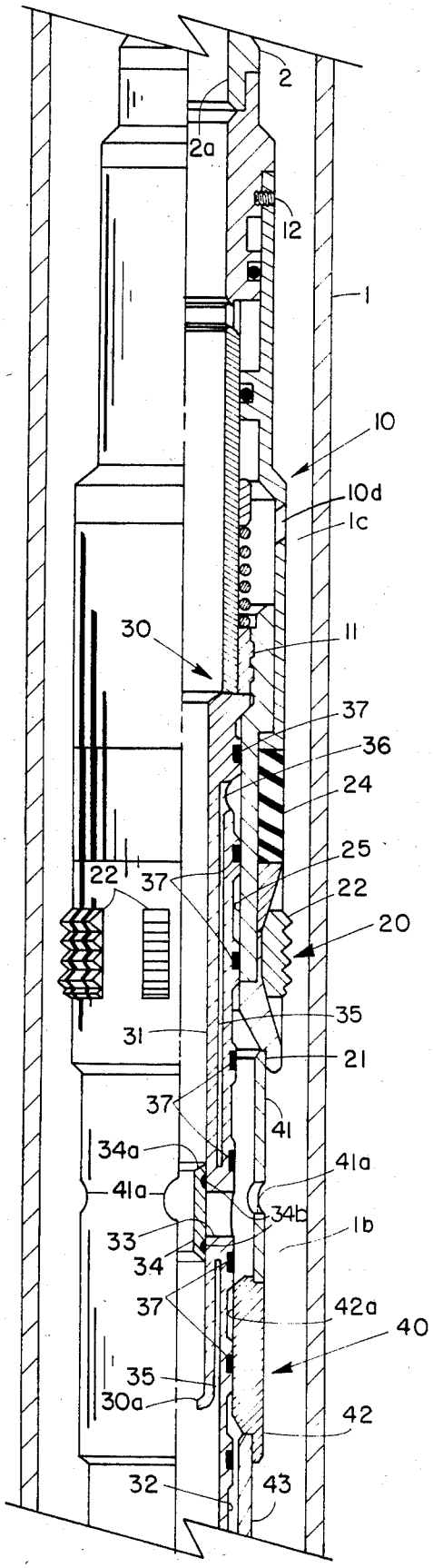
FIGS. 1A, 1B, 1C and 1D collectively constitute vertical, sectional views of a combined gravel packing and perforating apparatus embodying this invention, shown in its run-in position.

Referring to FIGS. 1A–1D, a combined perforating and gravel packing apparatus embodying this invention comprises a tubular string of tools which are sequentially connected to the bottom end of a tubular work string or, if desired, a production string. In most instances, however, a work string is employed for inserting the apparatus into the well casing and is subsequently removed after the completion of the perforating and gravel packing operations, to remove with the string the setting tool for the hydraulically actuated packer, and also the crossover mandrel.

Starting at the top of the tool string 2 which is insertable within a well casing 1, a hydraulic setting tool 10 is conventionally secured to the bottom end of the work string 2 by threads (not shown). In the run-in position of the assemblage, the setting tool 10 is detachably secured to a fluid pressure actuated packer 20 as by conventional left hand square threads 11. The packer may comprise any one of a number of well known types of fluid pressure actuated packers, such as Model SC-1L Packer, Product #488-02, produced by BAKER SAND CONTROL DIVISION, BAKER OIL TOOLS, INC. Similarly, the hydraulic setting tool 10 may comprise the Model B1 Hydraulic Setting tool, Product #445-20 produced by the same company.

Setting tool 10 is conventionally secured to an axially extending, tubular crossover mandrel 30. In its run-in position, the crossover mandrel 30 defines a substantially uninterrupted axial fluid passage 31 which extends downwardly through the upper packer 20 and the production screen 50 which will be subsequently described.

Packer 20 is provided with the conventional peripherally spaced slips 22 which are expandable through the application of predetermined fluid pressure applied through the bore **2*a* of the tubular work string 2 to expand into biting engagement with the interior wall of casing 1. As is conventional, the hydraulic setting tool 10 is provided with shear pins 12 preventing its operation to set the packer 20 until a fluid pressure of predetermined magnitude is applied through the bore 2*a* of the work string 2. Additionally, packer 20 includes an expandable elastomeric seal structure 24 which effects a sealing engagement with the bore of casing 1**.

The lower end of packer 20 is threadably secured by threads 21 to a liner assemblage 40. Liner assemblage 40 includes a pipe section 41 having a plurality of ports **41*a* formed therein, a seal bore section 42 defining an internal, cylindrical seal bore surface 42*a*, an extension pipe section 43 and a conventional shearout safety joint 44. The bottom end of shearout safety joint 44 is conventionally connected to a section of pipe 45 having projecting annular ribs 45*a***.

Production screen 50 is threaded or otherwise suitably rigidly secured to the pipe 45 and may, for example, comprise the BAKERWELD screen, Product #486-05 produced by BAKER SAND CONTROL DIVISION OF BAKER OIL TOOLS, INC. The lower end of the production screen 50 is connected to a seal bore sleeve 51, which connects to a reducing sub 52, which in turn is connected to a seal bore sub 54. Sub 54 is connected to the top end of a packer unit 60. Such packer unit may, for example, comprise the Model "RS" Packer, Product #448-30, produced by the BAKER SAND CONTROL DIVISION OF BAKER OIL TOOLS, INC. Packer 60 includes a plurality of peripherally spaced slips 62 and a plurality of radially, expansible bands 64 of elastomeric material. Drag segments 63 are mounted below slips 62. Packer 60 is set by mechanical manipulation of the tubing string in a conventional fashion well known to those skilled in the art.

The lower end 66 of packer 60 is threadably connected to an expandable connecting sub 67 which in turn is threadably connected to the upper end of a crossover tool 70. The lower end of crossover tool 70 is in turn threadably connected as at 71 to the upper portion of a firing mechanism or hammer housing 80. The lower end of hammer housing 80 is connected by threads **80*d* to a firing head 90, which in turn is threadably connected as at 91 to the housing of a perforating gun 100 of conventional configuration. For example, perforating gun 100 may comprise Model SPF-4, Tubing Conveyed Perforating Gun, Product #492-51 produced by the aforesaid BAKER SAND CONTROL DIVISION OF BAKER OIL TOOLS, INC. Perforating gun 100 includes a plurality of peripherally and vertically spaced shaped charge containers 102 which, when fired, will produce a desired number and distribution of perforations through the adjoining well casing 1** and the adjoining production formation.

Having thus generally described all of the individual components of the combined perforating and gravel packing apparatus, the individual components will now be described in detail, but taken in the sequence of their operation in accordance with the method of this invention.

Figure 2C:
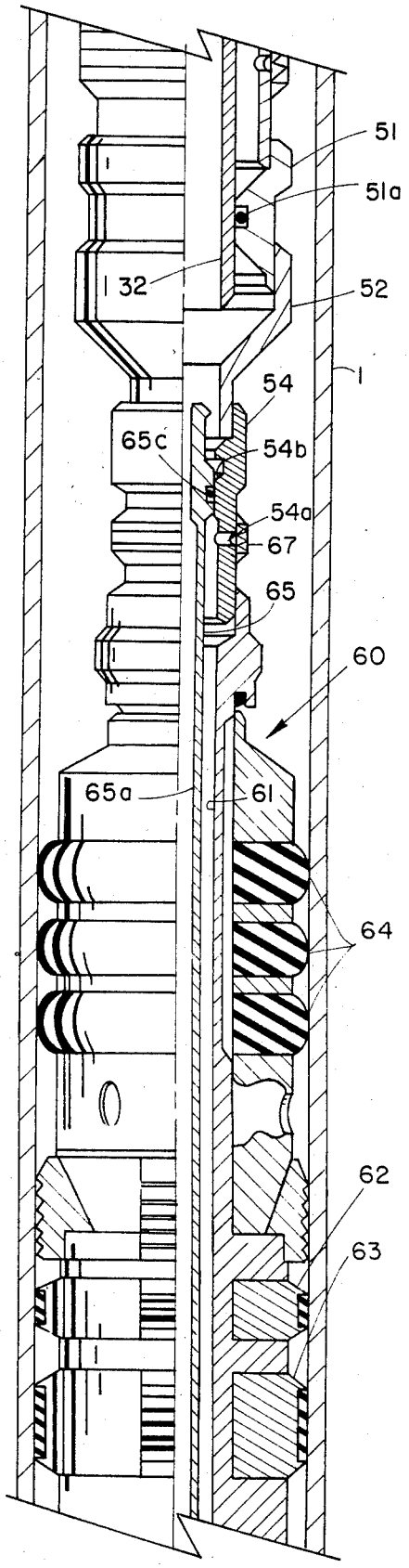
FIGS. 2C and 2D are respectively similar to FIGS. 1C and 1D and illustrate the position of the components after firing the perforating gun.
Figure 1D:
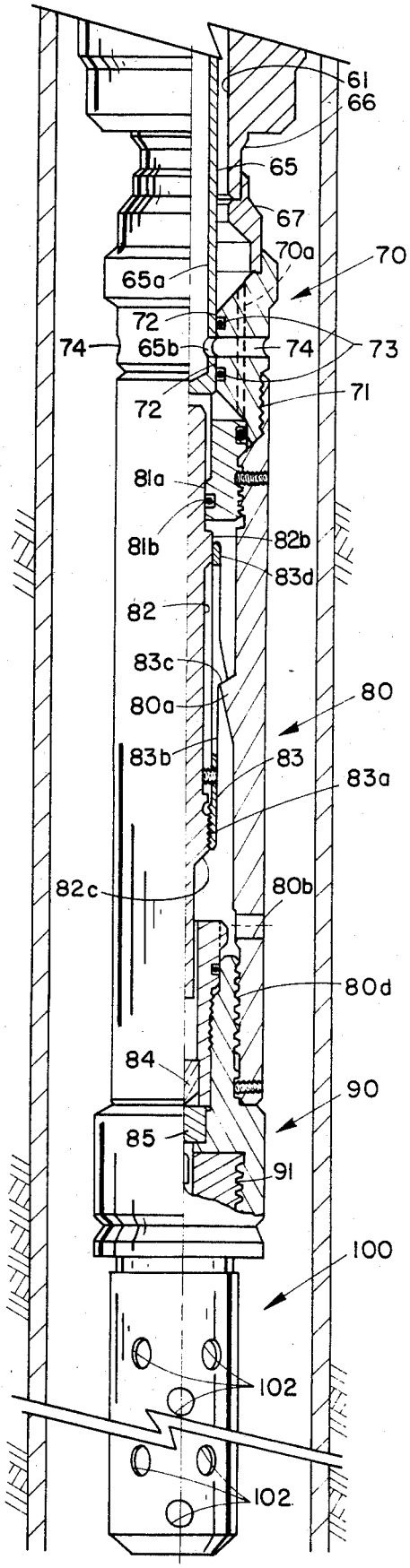

Obviously, the first step in the method is to effect the assemblage of the above enumerated components on the end of the tubular work string 2. The assembled tool string is then lowered into the well casing 1 until the perforating gun 100 is positioned adjacent the formation which it is desired to perforate. The lower packer 60 is then set by the conventional manipulation of the tool string 2 so that the slips 62 and the elastomeric sealing elements 64 assume their expanded positions shown in FIG. 2C.

Firing head 90 is then actuated by fluid pressure which is applied to the interior of the hammer housing 80. The fluid pressure operated mechanism contained within the hammer housing 80 preferably comprises that described in the aforementioned co-pending application, Ser. No. 593,364, filed concurrently herewith (BSC-102). Hammer housing 80 defines an internal bore **81*a* within which a hammer-piston element 82 is slidably and sealably mounted by seal 81*b*. Hammer housing 80 also defines an inwardly projecting latching rib 80*a*. A latching collet 83 is secured to the exterior of the piston hammer 82 by threads 83*a* and provides a plurality of axially extending, resilient arms 83*b*, each of which has a latching projection 83*c* engagable in the cocked position of hammer-piston 82 with the upwardly facing surface of the latching rib 80*a*. The extreme upper end portions 83*d* of the arms of collet 83 are supported on a peripheral rib 82*b* formed on the hammer-piston 82. Thus the hammer-piston 82 will be retained in its upper, cocked position until sufficient fluid pressure force is provided to its upper surface to force the collet arms 83*b* inwardly and release the latching projections 83*c* from the latching rib 80*a***.

Figure 5D:
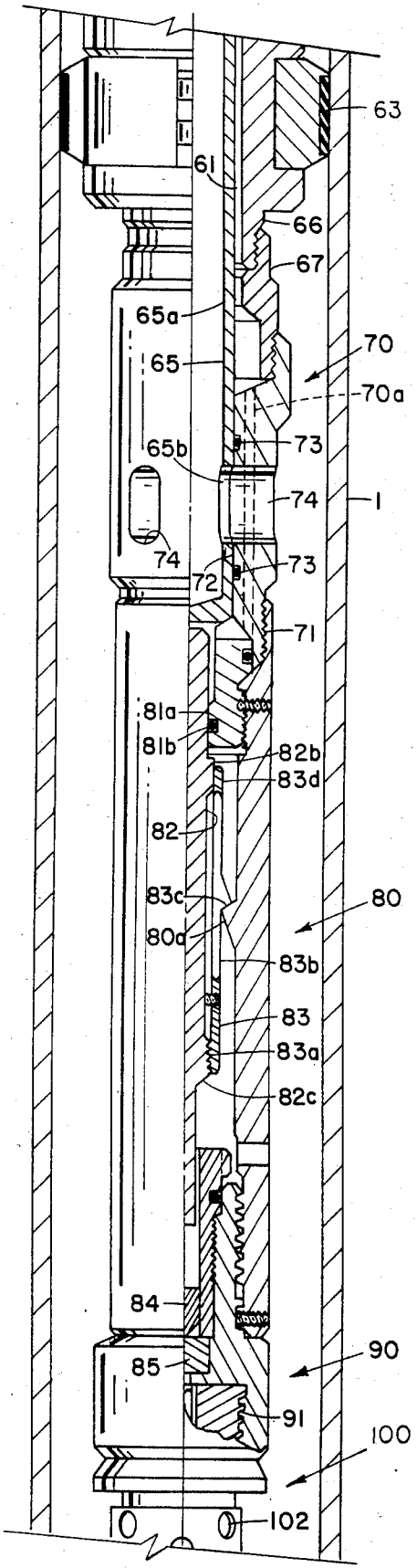
FIGS. 5C and 5D respectively constitute enlarged scale views corresponding to FIGS. 1C and 1D illustrating the fluid passages through the packer and crossover tool by which casing annulus pressure is supplied to the hammer housing to drive the hammer to fire the perforating gun.
Figure 1B:
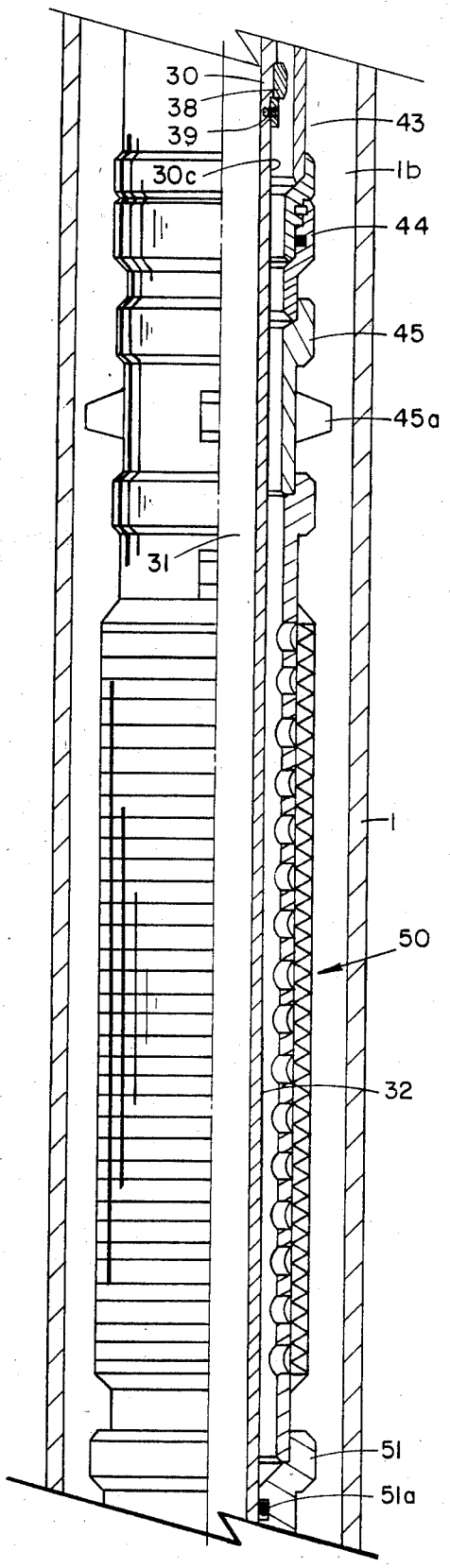
Figure 5C:
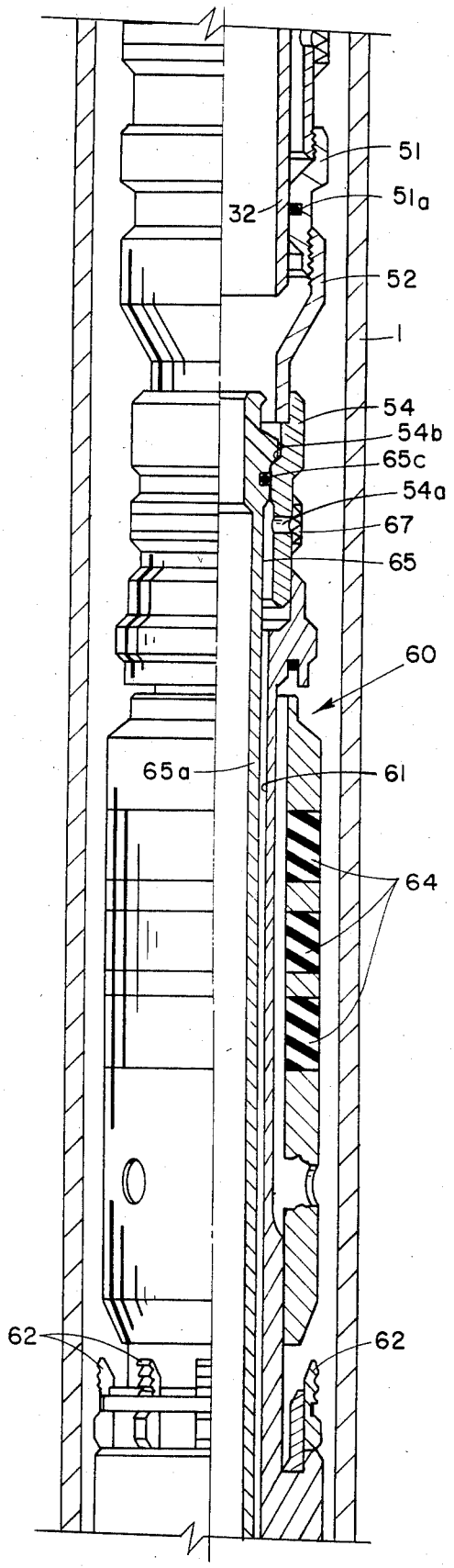
Figure 1C:
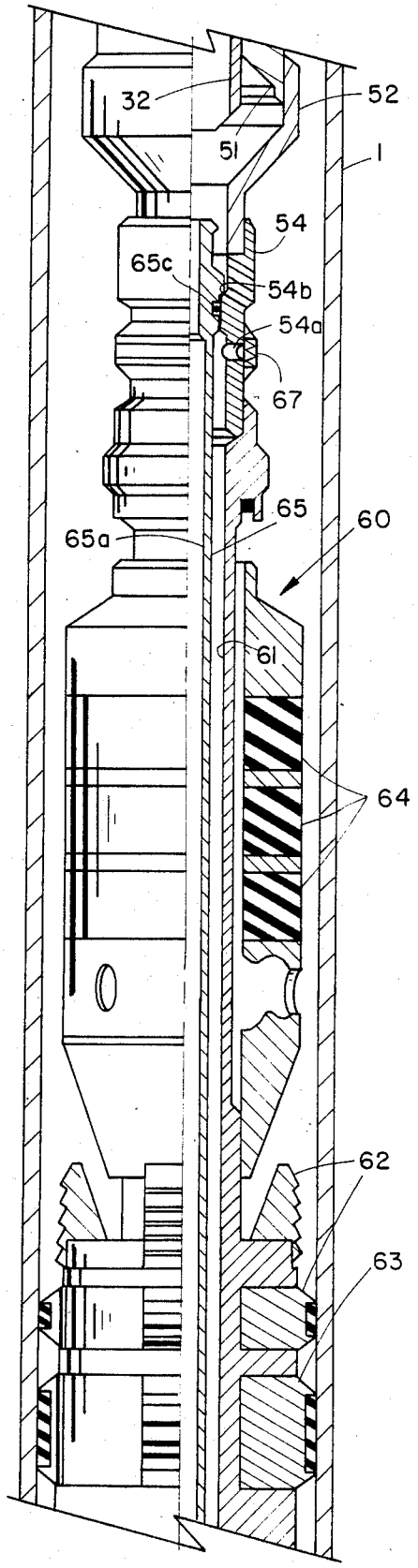

The actuating fluid pressure for the hammer-piston 82 is supplied from the casing annulus above the lower packer 60 through the crossover tool 70. Tool 70 defines one or more axially extending fluid passages **70*a* (FIG. 5D) which communicate with a similar passage 61 extending through the lower packer 60 and connecting with the casing annulus above such packer by radial ports 54*a* in seal bore sub 54. Screen 67 protects ports 54*a* from entry of gravel during the gravel packing step. The central bore 72 of the crossover tool 70 sealably mounts the extreme lower end of a tube 65 extending axially upwardly through packer 60 and suspended from an internal shoulder 54*b* in seal bore sub 54. Seal 65*c* engages seal bore sub 54. More specifically, axially spaced, annular seals 73 mounted in the bore 72 of crossover tool 70 sealingly engage the periphery of the axial tube 65 on each side of a plurality of radial ports 65*b*. Thus fluid pressure applied through the tubing string 2 has a substantially unimpeded passageway through the bore 31 of crossover mandrel extension 32, through the bore 65*a* of axial tube 65, into the crossover tool 70 and thence outwardly through radial ports 65*b* and 74 into the casing annulus below the mechanically set lower packer 60. Thus, the casing annulus fluid pressure immediately adjacent the hammer housing 80 is determined by the fluid pressure applied through the work string 2, while the internal pressure within hammer housing 80 applied to the hammer-piston element 82 is supplied from the casing annulus fluid pressure existing above the packer 60. As mentioned, increasing the casing annulus pressure above the lower packer 60 to a level sufficient to trip the latching collet 83 will release the hammer-piston 82 and drive it downwardly into impact engagement with a firing pin 84 which is mounted directly above a detonatable primer 85 which is fixedly mounted in the firing head 90. The discharge of primer 85 will effect the firing of the spaced shaped charges 102 mounted in the perforating gun 100** in conventional fashion.

It may happen that the impact energy imparted to the detonatable primer 85 by the hammer-piston 82 is insufficient to effect its detonation, so that a repetition of the impact blow may then fire the primer. The piston-hammer 82 is returned to its elevated, cocked position with respect to the firing pin 84 by reversing the pressure differential between the casing annulus pressure and the work string pressure. The hammer-piston 82 has downwardly facing surfaces **82*c* exposed to the adjacent casing annulus pressure through radial ports 80*b* provided in the hammer housing 80. When the pressure differential rises to a sufficient value to move hammer-piston 82 and the latching collet 83 upwardly past the latching rib 80*a*, the hammer 82 will be restored to its elevated cocked position, whereupon increasing the surface casing annulus pressure over the fluid pressure in the tubing string 2 will result in release of the hammer from its latched position and the delivery of a second impact to the detonable primer 85. It is therefore apparent that an unlimited number of impacts may be imparted to the detonable primer 85**, thus assuring that such primer will eventually be detonated, assuming that it is in firing condition.

Figure 2D:
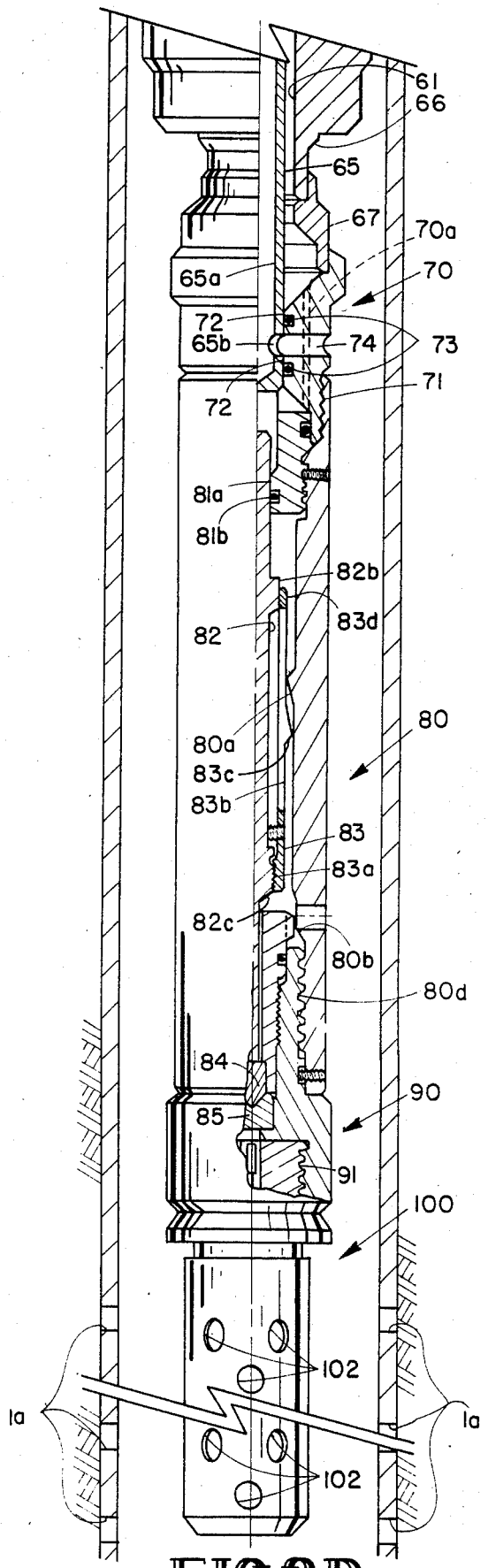

The position of the piston-hammer 82 at the instant of firing the perforating gun 100 is illustrated in FIG. 2D, as are the resulting casing perforations **1*a***.

When completing a well in certain formations, it is sometimes desirable to permit a flushing flow of production fluid out of the newly formed perforations in the formation immediately following the firing of the perforating gun. The apparatus embodying this invention conveniently permits such flow by virtue of the provision of the crossover port 74 provided in the crossover tool 70 which communicates between the casing annulus and the bore of the axial passage tube 65 which in turn communicates with the unobstructed axial passage 31 defined by the upper crossover mandrel 30 leading to the surface through work string 2.

The provision of the crossover tool 70 also permits the perforating of the production formation in the so-called "under balanced" condition, i.e., the fluid pressure in the casing annulus immediately adjacent the zone to be perforated is maintained at a substantially lower level than the fluid pressure existing in the formation. The crossover tool 70 permits the tubing string to be converted to a substantially dry condition prior to the perforating operation, hence removing substantially all fluid from the casing annulus adjacent the zone to be perforated. Alternatively, the work string may be filled with a light density liquid which will not substantially impede the flushing flow of formation fluid following the perforating operation.

To proceed with the gravel packing operation, work string 2 is then mechanically manipulated to effect the unsetting of the lower mechanically actuated packer 60. The entire tool string is then lowered so as to position the production screen 50 adjacent the newly formed casing perforations 1*a*, as illustrated in FIG. 3B. Conventional mechanical manipulation of the tool work string 2 will then effect the expansion of the slips 62 and the annular elastomeric sealing elements 64 into engagement with the bore of casing 1, as illustrated in FIG. 3C. The lower packer 60, the hammer housing 80 and the perforating gun 100 remain in the well during all subsequent operations, including subsequent production operations. Hence, the lower packer 60 and the subtended apparatus are not shown in further views illustrating the apparatus of this invention during the subsequent gravel packing operation.

Referring now to FIG. 1A, it was previously mentioned that the flow control crossover mandrel 30 defines an axial bore 31 which, in the run-in position of the tool string, is substantially unobstructed. One or more radial crossover ports 33 are provided in the side wall of the mandrel 30. In the run-in position of this tool, the radial ports 33 are normally sealed by a valve sleeve 34 having an upwardly facing ball valve seating surface 34*a* and two axially spaced, annular seals 34*b* for engaging the bore 31 at positions respectively above and below the radial ports 33. Shear pins (not shown) secure valve sleeve 34 in this position. Thus, fluid pressure applied through the bore 2*a* of the tubular work string 2 can pass through the entire length of the crossover mandrel 30, into the tubular mandrel extension 32 and thus pass through the screen 50 and into the tube 65 which traverses the lower packer 60, and then enter the central bore of the crossover tool 70 where it passes outwardly through the radial ports 74 into the casing annulus below lower packer 60 in the manner heretofore described.

Figure 3A:
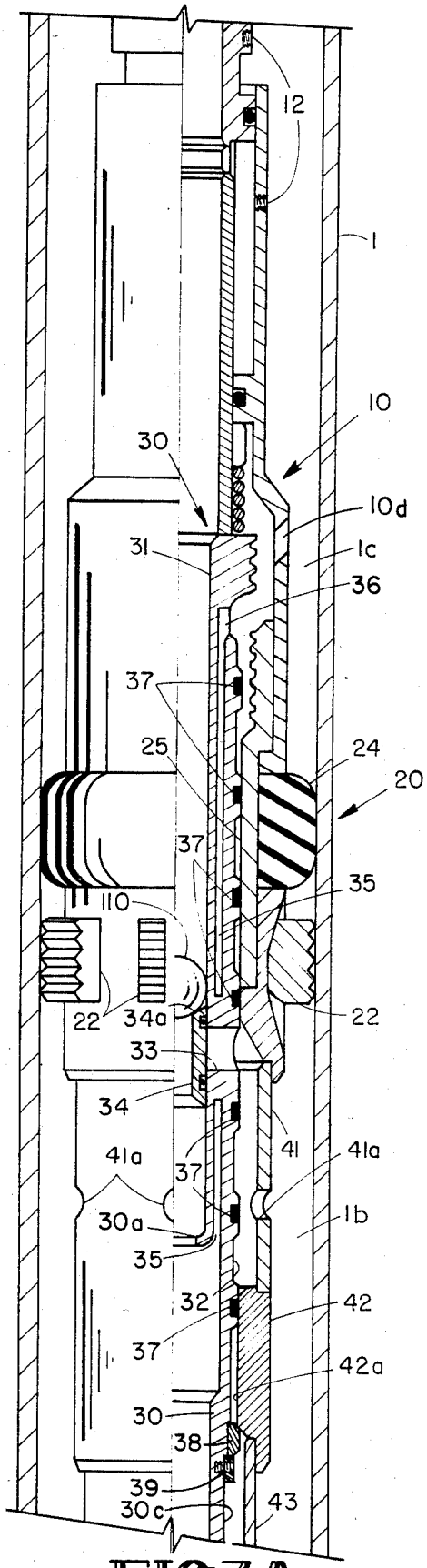
FIGS. 3A, 3B and 3C are views respectively similar to FIGS. 1A, 1B and 1C, but illustrating the position of the components of the apparatus prior to initiating the gravel packing operation.
Figure 3B:
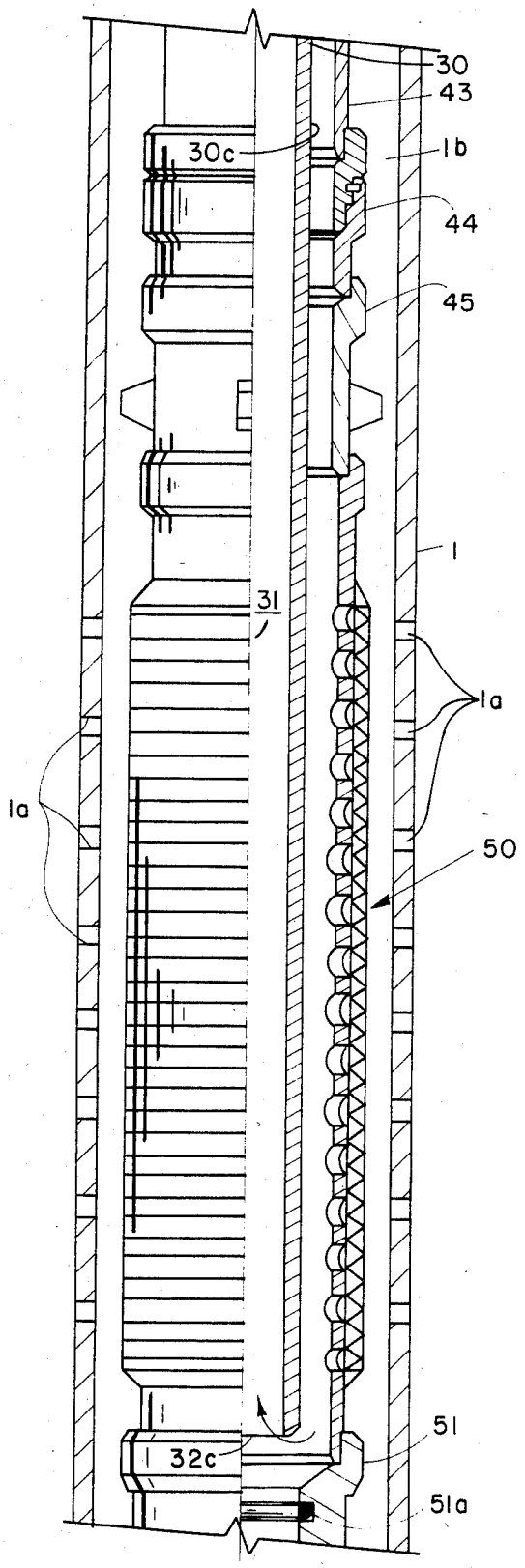
Figure 3C:
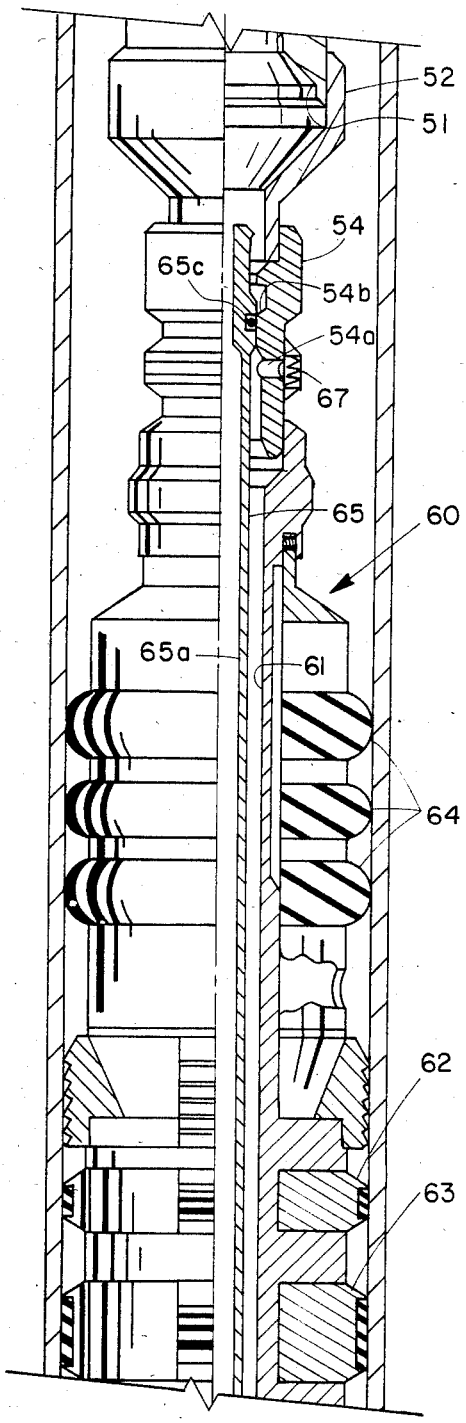

Additionally, the crossover mandrel 30 is provided with a second semi-annular, open bottom fluid passage 35 extending from the point below the radial ports 33 to a point adjacent the upper end of the mandrel 30 where it communicates with a radial port 36 which, when the mandrel 30 is elevated to the position shown in FIG. 3A, is in fluid communication with the casing annulus at a point above the elastomeric sealing element 24 of the upper packer 20. Additionally, the exterior of the flow control crossover mandrel 30 is provided with a plurality of axially spaced, external seal elements 37 which respectively cooperate with seal bores provided in the surrounding structures, such as the seal bore 25 of the upper packer 20, and the seal bore 42*a* previously mentioned, of the sleeve element 42 incorporated in the liner assembly. The extreme lower end of the mandrel extension 32 cooperates in sealing relationship with the annular seal 51*a* provided in the seal bore sleeve 51 at the bottom of the production screen 50.

The next step in the operation of the apparatus is to drop a ball or similar plug type valve element 110 through the work string 2 to seat in sealing relationship on the sealing surface 34*a* of the valve seat sleeve 34, as illustrated in FIG. 3A. The fluid pressure in the work string bore 2*a* is then increased to a level sufficient to effect the shearing of the shear pin 12 provided in the hydraulic actuating mechanism 10 and such mechanism proceeds to expand the slips 22 and the annular elastomeric sealing mass 24 into engagement with the bore of the casing 1, in conventional manner, as shown in FIG. 3A. Thus, the casing annulus containing the newly formed perforations 1*a* is sealed at its upper end by the annular seal 24 of the upper hydraulically operated packer 20 and at its lower end by the annular elastomeric seals 64 of the lower mechanically actuated packer 60.

The fluid pressure in the bore 2*a* of work string 2 is then further increased to a level sufficient to shear the pins (not shown) holding the valve seat sleeve 34 in its sealing position with respect to the radial crossover port 33. The valve seat 34 is moved downwardly until stopped by an inwardly projecting flange 30*a* formed on the body of the mandrel 30, as illustrated in FIG. 4A.

Figure 4A:
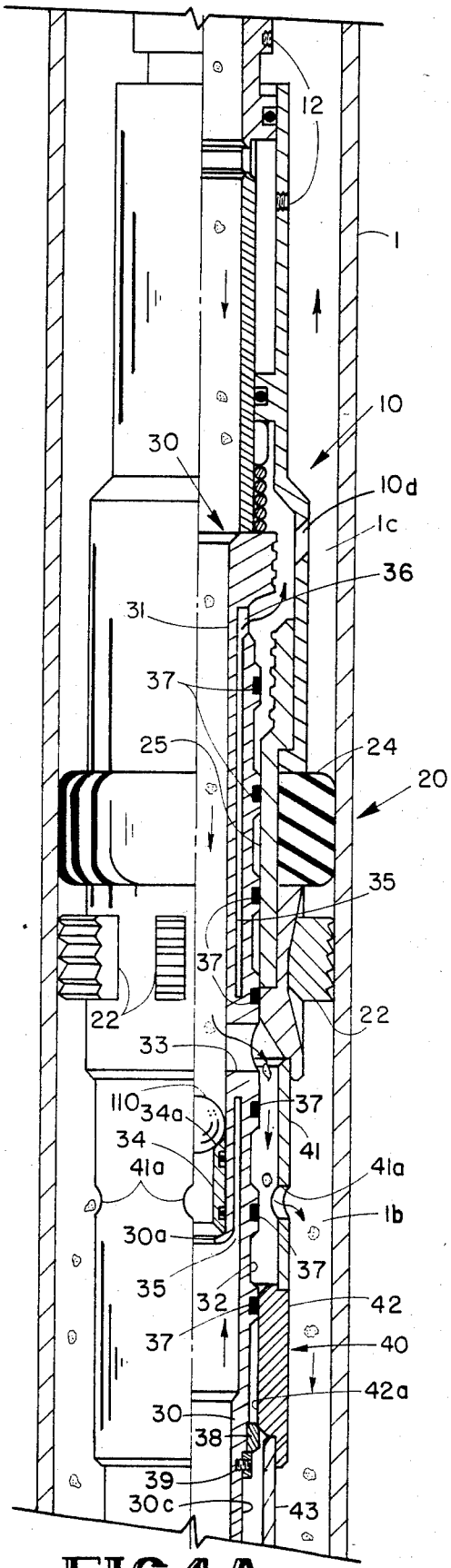
FIGS. 4A and 4B are views respectively similar to FIGS. 3A and 3B, but illustrating the position of components of the apparatus during the gravel packing operation.
Figure 4B:
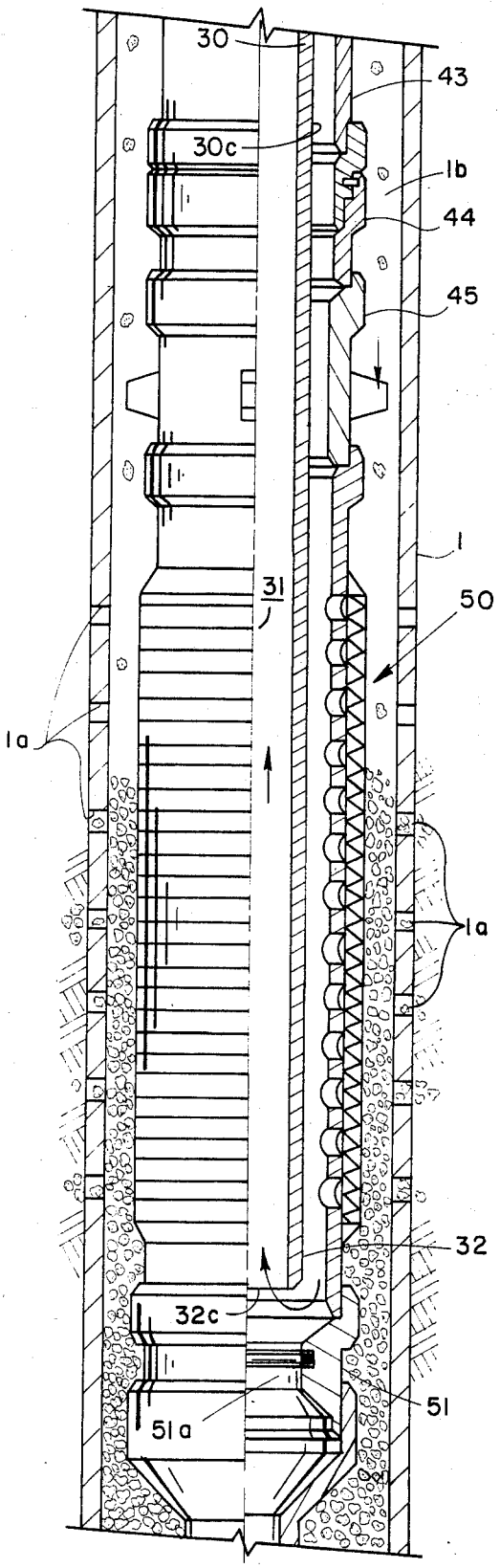

The hydraulic setting tool 10 is then released from the upper packer 20 by right hand rotation of the tubular work string 2 and the work string, and the connected setting tool 10 and the crossover mandrel 30 are elevated a slight distance until a locating ring 38 is brought into engagement with the downward facing surface of the seal bore sleeve 42 (FIG. 4A). This realigns the engagement of the various external annular seals 37 provided on the periphery of the crossover mandrel 30 with the internal seal bore surfaces provided along the tubular work string as shown in FIGS. 4A–4B. The locating ring 38 surrounding mandrel 30 is of C-shaped configuration and is expanded to engage the bottom end of the seal bore sleeve 42. Ring 38 is releasably retained in its expanded position on the crossover mandrel 30 by a sleeve 39 which is shearpinned to a reduced diameter external portion 30*c* of the crossover mandrel 30 so that the exertion of a substantial upward force on the work string will effect the shearing of the pin holding the sleeve 39 in position and permit the locating C-ring 38 to collapse around the reduced diameter portion 30*c* and thus be freely removable past the seal bore 42*a*.

Referring specifically to FIGS. 4A–4B, gravel packing of the production zone formations and the annulus between the casing 1 and the production screen 50 may then be accomplished in conventional fashion. A gravel carrying fluid is introduced into the central passage 31 of the crossover mandrel 30 through the tubular work string 2. The flow path of such gravel carrying fluid through the gravel packing portion of the tool string is conventional, passing from the axial bore 31 of the crossover mandrel and then radially outwardly through the crossover port 33 into the annulus between the crossover mandrel 30 and the surrounding liner assemblage 40. The fluid then flows through the ports 41*a* provided in the liner sleeve 41 into the annulus 1*b* defined between the casing 1 and the outer periphery of the liner assemblage 40 and production screen 50. The gravel carrying fluid thus flows downwardly around the exterior of the production screen 50 and through the perforations 1*a* into the perforations in the production formation. The gravel portion of the fluid flow is deposited in the perforations and around the production screen 50 while the fluid portion flows into the now exposed open bottom end 32*c* of the mandrel extension 32 and thence upwardly into the semi-annular fluid passage 35 provided in the mandrel 30 and then outwardly through the port 36, which is now positioned above the elastomeric sealing element 24 of the upper packer 20 and thence through space 10*d* into the casing annulus 1*b* above the packer 20.

The gravel packing operation is continued until the pressure buildup indicates to the operator that the entire production screen 50 and the adjacent area of the formation has been filled with gravel.

If a reverse flow is desired to remove excess gravel from the tubular work string, such may be accomplished by further raising the tubular work string 2, thus shearing the shear pin holding the locating ring 38 in position and elevating the cross-over port 33 to a position above packer 20 and applying a reverse fluid flow down the casing annulus 1*c*, through the crossover port 33 into the bore 31 of the mandrel 30 and thence upwardly through the tubular work string 2. Such upward movement of the work string locates the external annular seals 37 immediately below the crossover port 33 in engagement with seal bore 25 defined in the upper packer 20, thus effectively preventing loss of reversing fluid to the producing formation.

Following the reverse fluid flow operation and the removal of the excess gravel, the setting tool 10, with the crossover mandrel 30 connected thereto, is removed from the well and the well is ready for subsequent testing or production operations.

From the foregoing description, those skilled in the art will recognize that this invention provides a combined single trip perforating and gravel packing operation having the unusual property of permitting the repeated dropping of the hammer on the detonatable primer through the successive applications of fluid pressure through the casing annulus. At the same time, the fluid pressure operations employed to effect the repeated actuation of the hammer in no manner effect the premature setting of the upper hydraulically operated packer. Furthermore, the second crossover tool provided in the assemblage for the purpose of isolating the operation of the fluid pressure actuated hammer from that of the pressure actuated packer has the further advantage of providing passages permitting the immediate flushing flow of fluid from the formation immediately after firing of the perforating gun.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A combined gravel packing and perforating apparatus insertable in a cased well by a tubing string, said apparatus including: a fluid pressure operated packer, a screen dependent therefrom and a perforating gun and firing assembly suspended below said screen; said packer being settable by fluid pressure in said casing string; means responsive to internal fluid pressure in said firing assembly for firing said perforating gun; and a crossover tool disposed below said packer to direct casing annulus fluid pressure to the interior of said firing assembly, whereby said perforating gun may be fired by fluid pressure without setting said fluid pressure operated packer.

2. The apparatus of claim 1 wherein said firing assembly comprises a primer ignitable by the application of impact energy reaching a predetermined total, a housing fixedly supporting the primer; a hammer axially shiftably mounted in said housing above said primer; means whereby downward movement of said hammer transfers impact energy to said primer; securing means for securing said hammer in an elevated position relative to said primer; said securing means being responsive to a predetermined downward force to release said hammer; and fluid pressure responsive means supplied with fluid pressure from the well head for exerting sufficient downward force on said hammer to release same from said securing means.

3. The apparatus of claim 1 wherein said firing assembly comprises a hammer-piston vertically movable in a bore; first conduit means for connecting the upper portions of said bore to said crossover tool to receive surface applied casing annulus fluid pressure; and second conduit means connecting the lower portions of said bore to the adjacent casing annulus.

4. Apparatus for perforating and gravel packing a cased well in a single trip comprising, in combination: a series connected tubular assembly including first and second packer means; a screen on said tubular assembly and positioned between said packers, a first crossover tool below said second packer, and a hammer housing and a perforating gun below said first crossover tool; said tubular assembly defining an uninterrupted axial bore to said first crossover tool; means for selectively and repeatedly setting said first packer; a tubular second crossover tool; means on the tubular assembly for connection to said second crossover tool; said second crossover tool defining a fluid passage extending downwardly through said screen and said second packer to said first crossover tool and a separate second fluid passage, whereby fluid pressure supplied to the casing annulus at the well top surface flows through the assembly to the interior of said hammer housing; a hammer slidably and sealably mounted in said hammer housing; means for securing said hammer in an elevated position; said hammer having an upper surface exposed to the surface casing annulus fluid pressure above said second packer and a downwardly facing surface exposed to adjacent casing annulus pressure; whereby a determined differential in casing annulus fluid pressure over well bore fluid pressure will move said hammer in one direction from a first position to attempt to fire said perforating gun, and a predetermined differential in well bore fluid pressure over casing annulus fluid pressure will return said hammer to said first position; said second packer being first set to position said perforating gun at the desired position and, after firing said perforating gun, being subsequently releasable from its set position and lowered below the casing perforations by the tubing string and resettable in said lowered position; a valve seat sleeve mounted in the bore of said second crossover tool; means for retaining said sleeve in an initial run-in position; said sleeve receiving sealable means for sealing relation with said sleeve after the perforating operation, thereby permitting build up of fluid pressure in the tubular string; said first packer being then activatable into sealing engagement with said casing above said perforations; said second crossover tool having flow passages and spaced sealing means selectively positionable upon movement of said seal means relative to said first packer from said initial run-in position to a second position for directing gravel carrying fluid flowing downwardly through the tubular string into the well casing annulus between said first and second packers, thence through said screen into the bottom of said second crossover tool, and thence outwardly into the well casing annulus at a point above said upper packer, thereby permitting the packing of gravel around said screen; said valve seat sleeve being shiftable to said second position upon a further increase in fluid pressure in said tubing string.

5. Apparatus for perforating and gravel packing a cased well in a single trip comprising, in combination: a series connected tubular assembly including first and second packer means; a screen on said tubular assembly and positioned between said packers, a first crossover tool below said second packer, and a hammer housing and a perforating gun below said first crossover tool; said tubular assembly defining an uninterrupted axial bore to said first crossover tool; means for selectively and repeatedly setting said first packer; a tubular second crossover tool; means on the tubular assembly for connection to said second crossover tool; said second crossover tool defining a fluid passage extending downwardly through said screen and said second packer to said first crossover tool and a separate second fluid passage, whereby fluid pressure supplied to the casing annulus at the well top surface flows through the assembly to the interior of said hammer housing; a hammer slidably and sealably mounted in said hammer housing; means for securing said hammer in an elevated position; said hammer having an upper surface exposed to the surface casing annulus fluid pressure above said second packer and a downwardly facing surface exposed to adjacent casing annulus pressure; whereby a determined differential in casing annulus fluid pressure over well bore fluid pressure will move said hammer in one direction from a first position to attempt to fire said perforating gun; said second packer being first set to position said perforating gun at the desired position and, after firing said perforating gun, being subsequently releasable from its set position and lowered below the casing perforations by the tubing string and resettable in said lowered position; a valve seat sleeve mounted in the bore of said second crossover tool; means for retaining said sleeve in an initial run-in position; said sleeve receiving sealable means for sealing relation with said sleeve after the perforating operation, thereby permitting build up of fluid pressure in the tubular string; said first packer being then activatable into sealing engagement with said casing above said perforations; said second crossover tool having flow passages and spaced sealing means for directing gravel carrying fluid flowing downwardly through the tubular string into the well casing annulus between said first and second packers, thence through said screen into the bottom of said second crossover tool, and thence outwardly into the well casing annulus at a point above said upper packer, thereby permitting the packing of gravel around said screen; said valve seat sleeve being shiftable to said second position upon a further increase in fluid pressure in said tubing string.

6. Apparatus for perforating and gravel packing a cased subterranean well in a single trip comprising, in combination: a series connected tubular assembly including an upper packer of the fluid pressure type, a lower mechanically resettable packer; a production screen mounted between said packers; a first crossover tool below said lower packer, a hammer housing and a perforating gun mounted below said crossover tool; said tubular assembly defining an uninterrupted axial bore to said crossover tool; a tubular setting tool for said upper packer releasably secured thereto; means on the upper end of said setting tool for connection to a tubular string; a tubular second crossover tool; means on the lower portions of said setting tool for connection to said second crossover tool; said second crossover tool defining a central passage extending downwardly through said screen and said lower packer to said first crossover tool, and a separate semi-annular fluid passage surrounding a portion of said central passage, whereby fluid pressure supplied to the casing annulus flows through the assembly to the interior of said hammer housing; means in said hammer housing movable in response to said internal fluid pressure to fire said perforating gun; said first packer being first set to position said perforating gun at the desired level and being subsequently releasable from its set position after firing of said perforating gun, and lowered below the casing perforations by the tubular string and resettable in said lowered position; a valve seat sleeve mounted in the bore of said hollow mandrel assembly; means for retaining said sleeve in an initial run-in position; said sleeve receiving an element for sealing relation after the perforating operation, thereby permitting build up of fluid pressure in the tubular string; said second packer being then expandable by said fluid pressure into sealing engagement with the casing above said perforations; flow passage means in said second crossover tool produced by movement of said valve seat means downwardly relative to said second packer from said initial run-in position to a second position for directing gravel carrying fluid flowing downwardly through the tubing string into the well bore between said first and second packers, thence through said screen into the bottom of said second crossover tool, and thence outwardly into the well casing annulus at a point above said upper packer, thereby permittng the packing of gravel around said hollow screen; said valve seat sleeve being shiftable to said second position upon a further increase in fluid pressure in said tubing string.

7. The apparatus of claim 6 wherein said hammer means includes a piston element vertically movable in a bore; first conduit means connecting the upper portions of said bore to said first crossover tool to receive casing annulus fluid pressure; and second conduit means connecting the lower portions of said bore to the adjacent casing annulus, whereby said hammer means may be repeatedly fired by reversing the differential between tubing string pressure and casing annulus pressure.

8. The apparatus of claim 6 further comprising means for resiliently latching said piston in an upper position in said bore.

9. Apparatus for perforating and gravel packing a cased well in a single trip comprising, in combination: a series connected tubular assembly including an upper packer of the fluid pressure resettable type, a lower mechanically resettable packer, a screen between said packers, a first crossover tool below said lower packer, and a hammer housing and a perforating gun below said crossover tool; said tubular assembly defining an uninterrupted axial bore to said crossover tool; a tubular setting tool for said upper packer releasably secured thereto; means on the upper end of said setting tool for connection to a tubular string; a tubular second crossover tool; means on the lower portions of said setting tool for connection to said second crossover tool; said second crossover tool defining a central passage extending downwardly through said screen and said lower packer to said first crossover tool and a separate semi-annular fluid passage surrounding a portion of said central passage, whereby fluid pressure supplied to the casing annulus at the surface flows through the assembly to the interior of said hammer housing, a hammer slidably and sealably mounted in said hammer housing; means for latching said hammer in an elevated position; said hammer having an upper surface exposed to the surface casing annulus fluid pressure above said lower packer and a downwardly facing surface exposed to adjacent casing annulus pressure; whereby a determined differential in casing annulus fluid pressure over well bore fluid pressure will move said hammer downwardly from said latched position to attempt to fire said perforating gun, and a predetermined differential in well bore fluid pressure over casing annulus fluid pressure will return said hammer to said elevated position; said first packer being first set to position said perforating gun at the desired level and, after firing said perforating gun, being subsequently releasable from its set position and lowered below the casing perforations by the work string and resettable in said lowered position; a valve seat sleeve mounted in the bore of said second crossover tool; means for retaining said sleeve in an initial run-in position; said sleeve receiving sealable means for sealing relation with said sleeve after the perforating operation, thereby permitting build up of fluid pressure in the tubular string; said second packer being then expandable by said fluid pressure into sealing engagement with said casing above said perforations; said second crossover tool having flow passages and spaced sealing means selectively positionable upon movement of said seal means downwardly relative to said second packer from said initial run-in position to a second position for directing gravel carrying fluid flowing downwardly through the tubular string into the well casing annulus between said first and second packers, thence through said screen into the bottom of said second crossover tool, and thence outwardly into the well casing annulus at a point above said upper packer, thereby permitting the packing of gravel around said hollow screen; said valve seat sleeve being shiftable to said second position upon a further increase in fluid pressure in said tubing string.

10. The method of perforating and gravel packing the production zone of a subterranean well with one trip of a tubing conduit, comprising the steps of:

assembling at the surface for attachment to the end of a tubing conduit: first and second packer means carried on said tubing conduit; screen means dependent from said tubing conduit; a perforating gun and firing assembly suspended below said screen means; and means responsive to said fluid pressure and said firing assembly for firing said perforating gun whereby said perforating gun may be fired by fluid pressure without setting said packer means; lowering the tubing conduit with the above listed components thereon into the well until the perforating gun is positioned adjacent to the desired production zone;

setting the first packer means in a position above the desired production formation with said perforating mechanism adjacent the desired production zone;

increasing the fluid pressure in the well annulus to a level sufficient to actuate said firing assembly;

releasing said first packer and lowering the tubing string to position said screen adjacent the perforated production zone, and then resetting said first packer; increasing the fluid pressure in the tubing string to a level sufficient to cause setting of said second packer; and introducing gravel carrying fluid through the tubing string to flow downwardly along the casing annulus between the first and second packers, through the screen, and upwardly through the tubing string to the casing annulus at a point above said second packer.

11. The method of perforating and gravel packing the production zone of a subterranean well with one trip of a tubing conduit, comprising the steps of:

assembling at the surface for attachment to the end of a tubing conduit, a hollow linear assembly including a production screen, a first settable and releasable packer secured to the lower end of the hollow liner assembly, a hydraulically settable second packer secured to the upper end of the hollow liner assembly, a crossover tool supported by the lower packer, a perforating gun supported below the crossover tool by a housing containing a hammer shiftable downwardly by a predetermined positive fluid pressure differential between the fluid pressure within the housing and the casing annulus pressure; a fluid pressure operated actuator releasably connected to the upper portions of the second packer, and a hollow cross-over mandrel assembly connected to the actuator and insertable within the liner assembly and defining an axial fluid passageway therethrough;

lowering the tubing conduit with the above listed components thereon into the well until the perforating gun is positioned adjacent to the desired production zone;

setting the first packer in a position above the desired production formation with said perforating mechanism adjacent the desired production zone;

increasing the fluid pressure in the well annulus to a level sufficient to actuate said hammer, said fluid pressure in the well annulus being transmitted to said hammer housing by said first crossover tool;

releasing said first packer and lowering the tubing string to position said screen adjacent the perforated production zone, and then resetting said first packer;

inserting a valve element through the work string to close said axial fluid passage in the hollow crossover mandrel assembly, thereby permitting fluid pressure to be built up within the tubing string;

increasing the fluid pressure in the tubing string to a level sufficient to cause the actuator to set said second packer;

increasing the fluid pressure in the tubing string to a level sufficient to cause the downward displacement of the valve element of said hollow crossover mandrel assembly and open a radial fluid passage from the bore of said hollow crossover mandrel to the bore of said liner assembly; and then introducing gravel carrying fluid through the tubing string to flow through passages defined by the hollow crossover mandrel and the hollow liner assembly downwardly along the casing annulus between said first and second packers, through the production screen, and upwardly through the crossover mandrel assembly to the casing annulus at a point above said second packer.

12. The method of perforating and gravel packing the production zone of a subterranean well with one trip of a tubing string comprising the steps of:

assembling at the surface for attachment to the end of a tubing string, a hollow liner assembly including a production screen, a first mechanically settable and releasable packer secured to the lower end of the hollow liner assembly, a fluid pressure settable second packer secured to the upper end of the hollow liner assembly, a cross-over tool supported by the lower packer, a perforating gun supported below the cross-over tool by a housing containing a hammer shiftable downwardly by a predetermined positive fluid pressure differential between the internal housing pressure and the well annulus pressure, a fluid pressure operated actuator releasably connected to the upper portions of said second packer, and a hollow crossover mandrel assembly connected to the actuator and insertable within the linear assembly and defining an axial passage with a horizontal annular valve seat intermediate said first and second packers, said axial passage extending through said production screen;

lowering the tubing string with the apparatus thereon into the well until the perforating mechanism is positioned adjacent to the desired production zone;

setting the first packer in a position immediately above the desired production formation with said perforating gun adjacent the desired production zone;

increasing the fluid pressure in the annulus to a level sufficient to actuate said hammer and fire the perforating gun, said fluid pressure passing through said crossover tool to enter the hammer housing;

releasing said first packer and lowering the tubing string to position said production screen adjacent the perforated production zone, and then mechanically resetting said first said packer;

dropping an element through the tubing string to seat on said annular valve seat in the hollow crossover mandrel assembly, thereby permitting fluid pressure to be built up within the tubing string;

increasing the fluid pressure in the tubing string to a level sufficient to cause the actuator to set said second packer;

increasing the fluid pressure in the tubing string to a level sufficient to cause the downward displacement of the valve seat element of said hollow crossover mandrel assembly and open a radial fluid passage from the bore of said hollow crossover mandrel to the bore of said liner assembly;

releasing said actuator from said second packer and elevating same relative to said second packer, thereby positioning the end of the mandrel axial passage within the production screen; and introducing gravel carrying fluid through the tubing string to flow through said radial passage and the annular passage defined between the hollow crossover mandrel and the hollow liner assembly, thence downwardly along the well annulus between said first and second packers, through the production screen, and upwardly through the crossover mandrel assembly to the casing annulus at a point above said second packer.

13. The method of claim 11 or 12 further comprising the step of permitting a flushing flow of formation fluids through the newly formed perforations prior to releasing and moving the first packer.

14. The method of perforating and gravel packing the production zone of a subterrean well with one trip of a tubing string comprising the steps of:

(1) assembling at the surface for attachment to the end of a tubing string, a hollow liner assembly including a production screen, a first settable and releasable packer secured to the lower end of the hollow liner assembly, a fluid pressure settable second packer secured to the upper end of the hollow liner assembly, a perforating gun supported below the lower packer by a housing containing a hammer shiftable downwardly by a predetermined positive fluid pressure differential between the fluid pressure within the housing and the adjacent casing annulus pressure and upwardly by a predetermined negative fluid pressure differential; a first crossover tool interposed between the lower packer and said hammer housing, a fluid pressure operated actuator releasably connected to the upper portion of the second packer, and a hollow crossover mandrel assembly connected to the actuator and insertable within the iner assembly and defining an axial passage;

(2) lowering the work string with the above listed components thereon into the well until the perforating gun is positioned adjacent to the desired production zone;

(3) setting the first packer in a position immediately above the desired production formation with said perforating gun adjacent the desired production zone;

(4) increasing the fluid pressure in the well annulus to a level sufficient to actuate said hammer, said well annulus fluid pressure being transmitted to said hammer housing by said first crossover tool;

(5) if the hammer fails to fire the perforating gun, reducing the fluid pressure in the well annulus below that in the tubular work string to return the hammer to its initial position;

(6) repeating steps 4 and 5 until the perforating gun fires to perforate the well;

(7) releasing said first packer and lowering the tubing string to position said production screen adjacent the perforated production zone, and then mechanically resetting said first packer;

(8) inserting a valve element through the tubing string to close said axial passage in the hollow crossover mandrel assembly, thereby permitting fluid pressure to be built up within the tubing string;

(9) increasing the fluid pressure in the tubing string to a level sufficient to cause the actautor to set said second packer;

(10) increasing the fluid pressure in the tubing string to a level sufficient to cause the downward displacement of the valve seat element of said hollow crossover mandrel assembly and open a radial fluid passage from the bore of said hollow crossover mandrel to the bore of said liner assembly; and then

(11) introducing gravel carrying fluid through the tubing string to flow through passages defined by the hollow crossover mandrel and the hollow liner assembly downwardly along the well annulus between said first and second packers, through the production screen, and upwardly through the crossover assembly to the well annulus at a point above said second packer.

15. The combination of perforating and gravel packing the production zone of a subterranean well with one trip of a tubing string comprising the steps of:

(1) assembling at the surface for attachment to the end of a tubing string, a hollow liner assembly including a production screen, a first settable and releasable packer secured to the lower end of the hollow liner assembly, a hydraulically settable second packer secured to the upper end of the hollow liner assembly, a perforating gun supported below the lower packer by a housing containing a hammer shiftable downwardly by a predetermined positive fluid pressure differential between the internal housing pressure and the well annulus pressure and upwardly by a predetermined negative fluid pressure differential, a crossover tool interposed between said lower packer and the hammer housing, a fluid pressure operated acutator releasably connected to the upper portions or the second packer, and a hollow crossover mandrel assembly connected to the actuator and insertable within the liner assembly and defining an axial passage with a horizontal annular valve seat intermediate said first and second packers;

(2) lowering the tubing string with the above apparatus components thereon into the well until the perforating mechanism is positioned adjacent the desired production zone;

(3) setting the first packer in a position immediately above the desired production formation with said perforating mechanism adjacent the desired production zone;

(4) increasing the fluid pressure in the well annulus to a level sufficient to actuate said hammer, said fluid pressure passing through said crossover tool to enter the hammer housing;

(5) if the hammer fails to fire the perforating gun, reducing the fluid pressure in the casing annulus above said first packer below that in the well annulus below said first packer to return the hammer to its initial position;

(6) repeating steps 4 and 5 until the perforating gun fires to perforate the well;

(7) releasing said first packer and lowering the tubing string to position said first packer below the perforated production zone, and then resetting said first packer;

(8) placing an element through the tubing string to seat on said annular valve seat in the hollow crossover mandrel assembly, thereby permitting fluid pressure to be built up within the upper portions of the tubing string;

(9) increasing the fluid pressure in the upper portions of the tubing string to a level sufficient to cause the actuator to set said second packer;

(10) increasing the fluid pressure in the tubing string to a level sufficient to cause the downward displacement of the valve seat element of said hollow crossover mandrel assembly and open a radial fluid passage from the bore of said hollow crossover mandrel to the bore of said liner assembly; and

(11) introducing gravel carrying fluid through the tubing string to flow through said radial passage and the annular passage defined between the hollow crossover mandrel and the hollow liner assembly, thence downwardly along the well annulus between said first and second packers, through the production screen, and upwardly through the crossover mandrel assembly to the well annulus at a point above said second packer.

16. The method of claim 15 further comprising the step of permitting a flushing flow of formation fluid through the newly formed perforations prior to releasing and moving the first packer.

17. The method of claim 11, 12, 14, or 15 wherein the fluid pressure in the tubing string is reduced below the level of the formation fluid pressure prior to firing the perforating gun, thereby perforating the formation in an underbalanced condition.

* * * * *